United States Patent [19]

McMillian et al.

[11] 4,109,139

[45] Aug. 22, 1978

[54] MULTI-NATIONAL COIN TOTALIZER

[75] Inventors: Lonnie S. McMillian, Huntsville; Harold G. Culp, Union Grove, both of Ala.

[73] Assignee: Systems & Technic S.A., Nyon, Switzerland

[21] Appl. No.: 663,058

[22] Filed: Mar. 2, 1976

Related U.S. Application Data

[63] Continuation of Ser. No. 460,531, Apr. 12, 1974, abandoned.

[51] Int. Cl.[2] ..... G07D 9/00

[52] U.S. Cl. ..... 235/92 CN; 133/8 R; 235/92 ST; 235/92 R

[58] Field of Search ..... 235/92 CN, 92 DM, 92 ST; 133/8 R; 194/DIG. 1, 4, 7, 1 M, 1 N

[56] References Cited

U.S. PATENT DOCUMENTS

| | | | |
|---|---|---|---|
| 2,472,542 | 6/1949 | Moerman | 235/92 CN |
| 2,523,516 | 9/1950 | Potter | 235/92 CN |
| 3,428,787 | 2/1969 | Mayerl | 235/92 ST |
| 3,803,497 | 4/1974 | Fah Mim Tyan | 235/92 ST |
| 4,007,358 | 2/1977 | Iguchi et al. | 235/92 CN |

*Primary Examiner*—Joseph M. Thesz
*Attorney, Agent, or Firm*—Curtis, Morris & Safford

[57] ABSTRACT

A coin sorter and totalizer which easily can be adapted to count the coins of many different countries despite the use of different coinage systems in those countries. The coins are sorted mechanically according to size, and an electrical signal identifying the coin according to its size is produced. Two sets of terminals are mounted near one another so that connections can be made to them easily. Changing these connections will change the scaling of the coin identification signals in accordance with the value of the coin of that size in the country in which the totalizer is to be used. The connections can be changed by the use of jumper wires, or by connecting a pre-wired multiple circuit element such as a printed circuit board, an integrated circuit chip, or a pre-wired plug-in panel between the sets of terminals. The connection process is very simple because only one wire need be connected for each size of coin to be totalized. The coin identification signals are stored temporarily in electrical latch circuits. The signals are readout of those simple storage devices by means of a stepping register. A multiplier circuit scales the identification signals, and a binary-code-decimal counter is driven to totalize the values of the coins. A light-emitting diode array displays the total value of the coins. A warning device is provided to indicate when a power interruption has occurred so that the coins can be sorted and totalized again to avoid an error.

15 Claims, 7 Drawing Figures

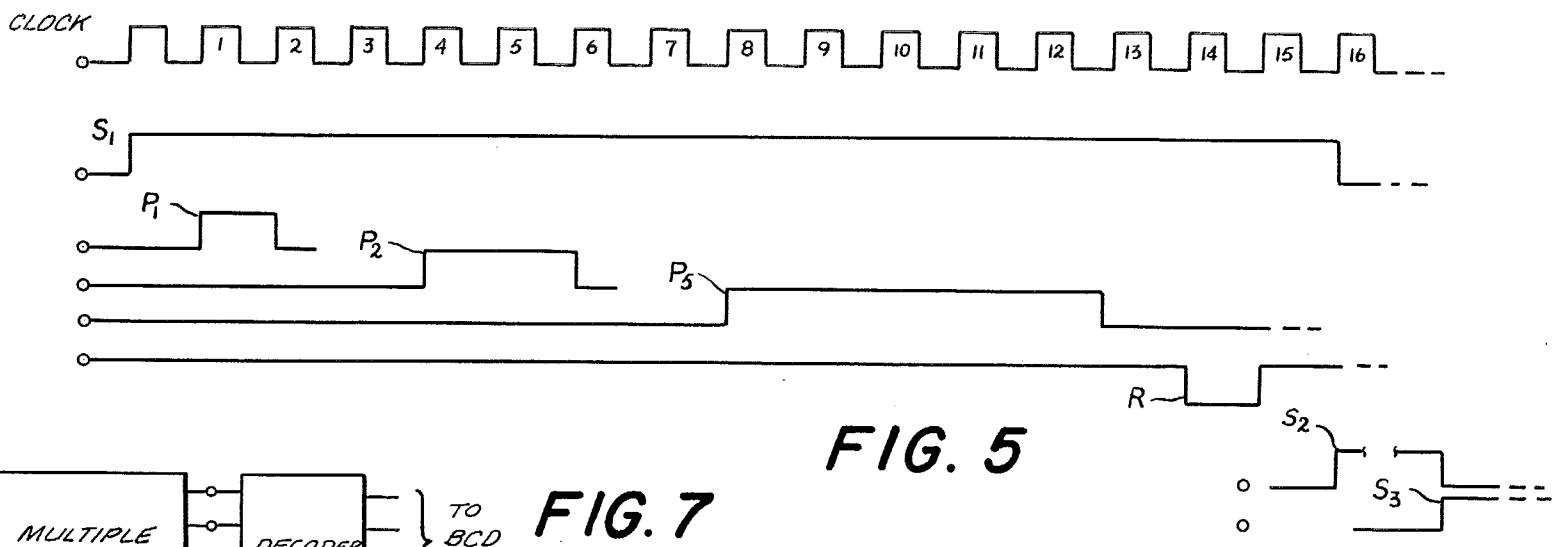
FIG. 5
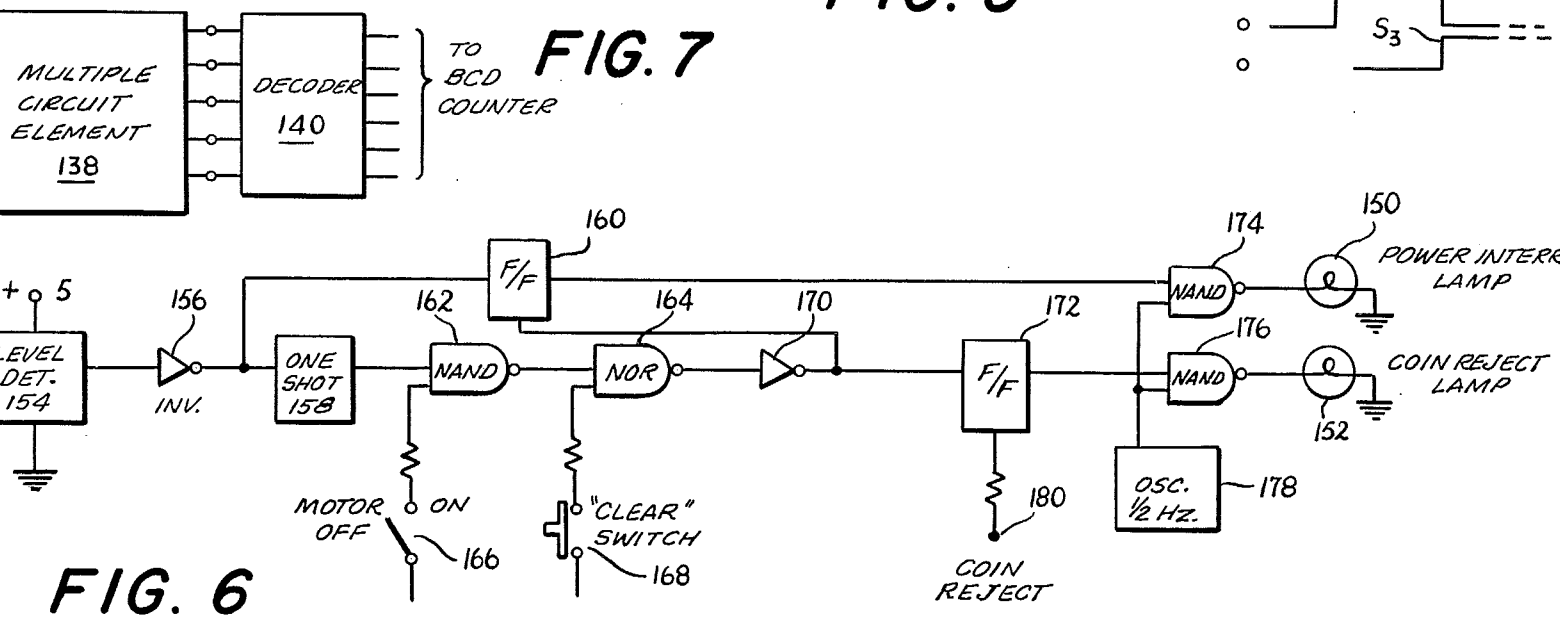
FIG. 7
FIG. 6

MULTI-NATIONAL COIN TOTALIZER

This is a continuation of U.S. patent application Ser. No. 460,531, filed Apr. 12, 1974, now abandoned.

This invention relates to devices for totalizing the value of coins; more particularly, this invention relates to devices and methods for sorting and totalizing the value of coins.

Devices of the type to which this invention pertains often are used in banks and by vending machine collectors and others who take in relatively large numbers of coins in their businesses. The devices sort the coins and separate them into different containers according to their denominations. The devices also add or totalize the value of the coins sorted.

One of the problems with prior coin value totalizers is caused by the substantial variations between systems of coinage in different countries throughout the world. For example, in many countries, such as the United States, the coin having the smallest value is equal to one-hundredth of the basic monetary unit (e.g., the dollar). In other countries, however, the lowest value is one-thousandth of basic monetary unit. The coinage differences from country to country make it very difficult to provide a standardized totalizer which easily can be modified for use in different countries.

Another problem with prior totalizer devices is that of unreliability caused by interruptions in the line voltage. Such interruptions cause erroneous readings without the knowledge of the operator of the device.

It is, therefore, an object of the present invention to provide an essentially standardized coin value totalizer and fabrication method which is essentially the same, regardless of the country in which it is to be used; one in which any modifications which are required are very easy to make. It is a further object to provide such a totalizer in which such modifications can be made with the use of relatively unskilled labor, and so simply that there is little chance of error. Another object of the invention is to provide a totalizer device which detects and gives a warning indication when power interruptions occur during the totalizing operation. It is a further object of the invention to provide such a device and method which is relatively simple and inexpensive to make and use.

In accordance with the present invention, the foregoing objects are met by the provision of a totalizer device with a construction such that two sets of terminals are provided, one providing coin identifyng signals, and the other for conducting signals to drive adding means to add the values of the coins. Connection between the adjacent terminals can be made easily and simply, such as by connecting only one jumper wire per type of coin being detected. Thus, for example, to adapt the device for totalizing coins in the United States, it would require the connection of only five jumper wires. A multiplier circuit is provided with inputs for each of the scaling values used to scale the signals from the coin identification means. The multiplier preferably makes unique combinations of pulses of one, two and five units of time duration each in order to multiply the coin identification signals by the appropriate scaling factor. The coin identification signals are stored temporarily and then read out sequentially by means of a stepping register. After multiplication, the signals are counted by a binary-code decimal counter, and the total is displayed on a six-digit light-emitting diode display panel. The coins are sorted by an electrically-driven mechanical sorter. A circuit is provided for detecting power interruptions which occur while the sorter is in operation. This circuit causes a lamp to flash and thus indicates that a power interruption has occured and allows the operator to recount and sort the coins to correct any possible error.

The foregoing and other objects and advantages will be pointed out in or apparent from the following description and drawings. In the drawings.

Figure 1:
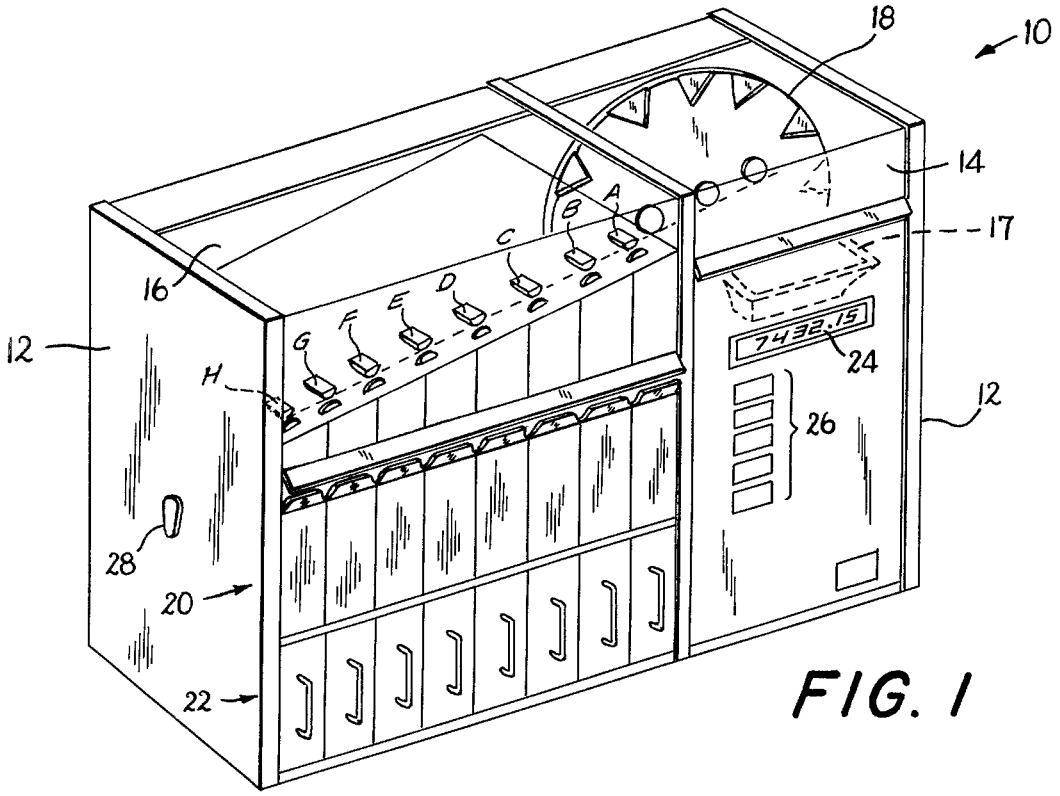
FIG. 1 is a perspective view of a sorter-totalizer device constructed in accordance with the present invention.
Figure 2:
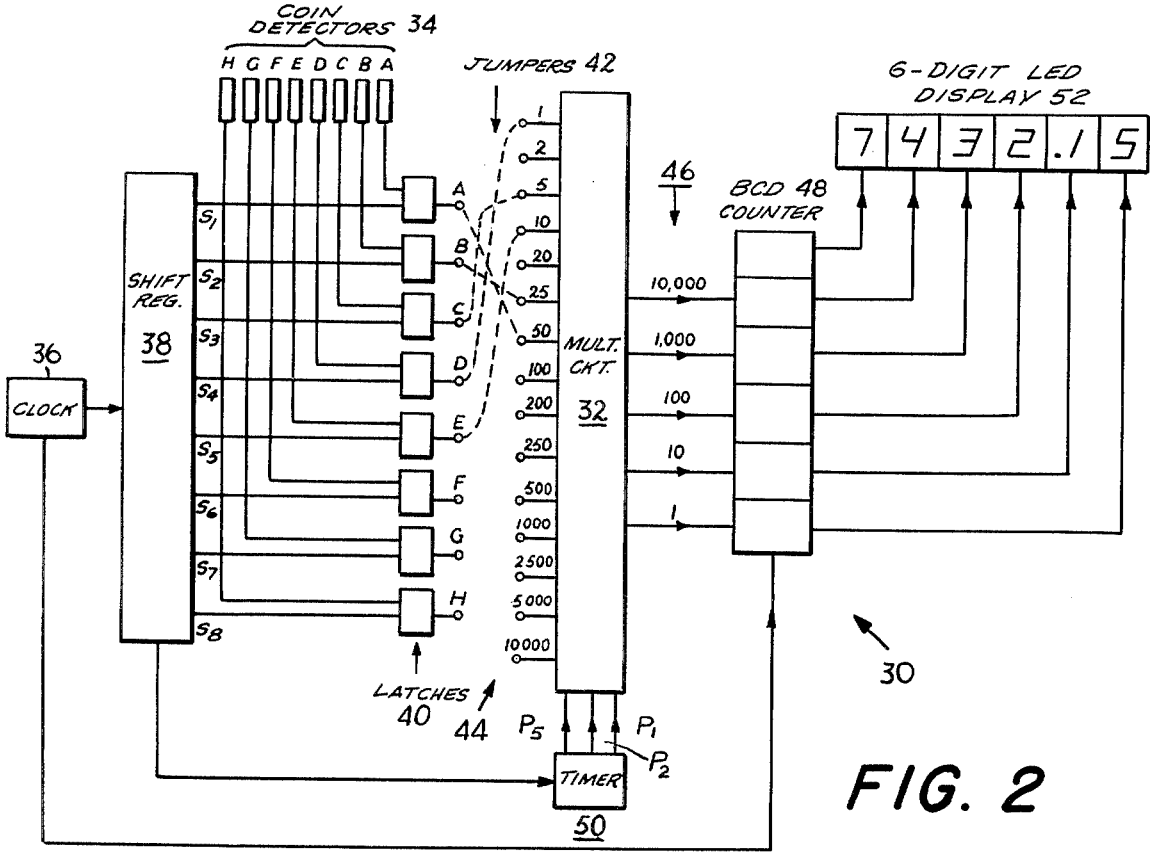
FIG. 2 is a schematic circuit diagram of the totalizing circuitry for the device shown in FIG. 1.
Figure 3:
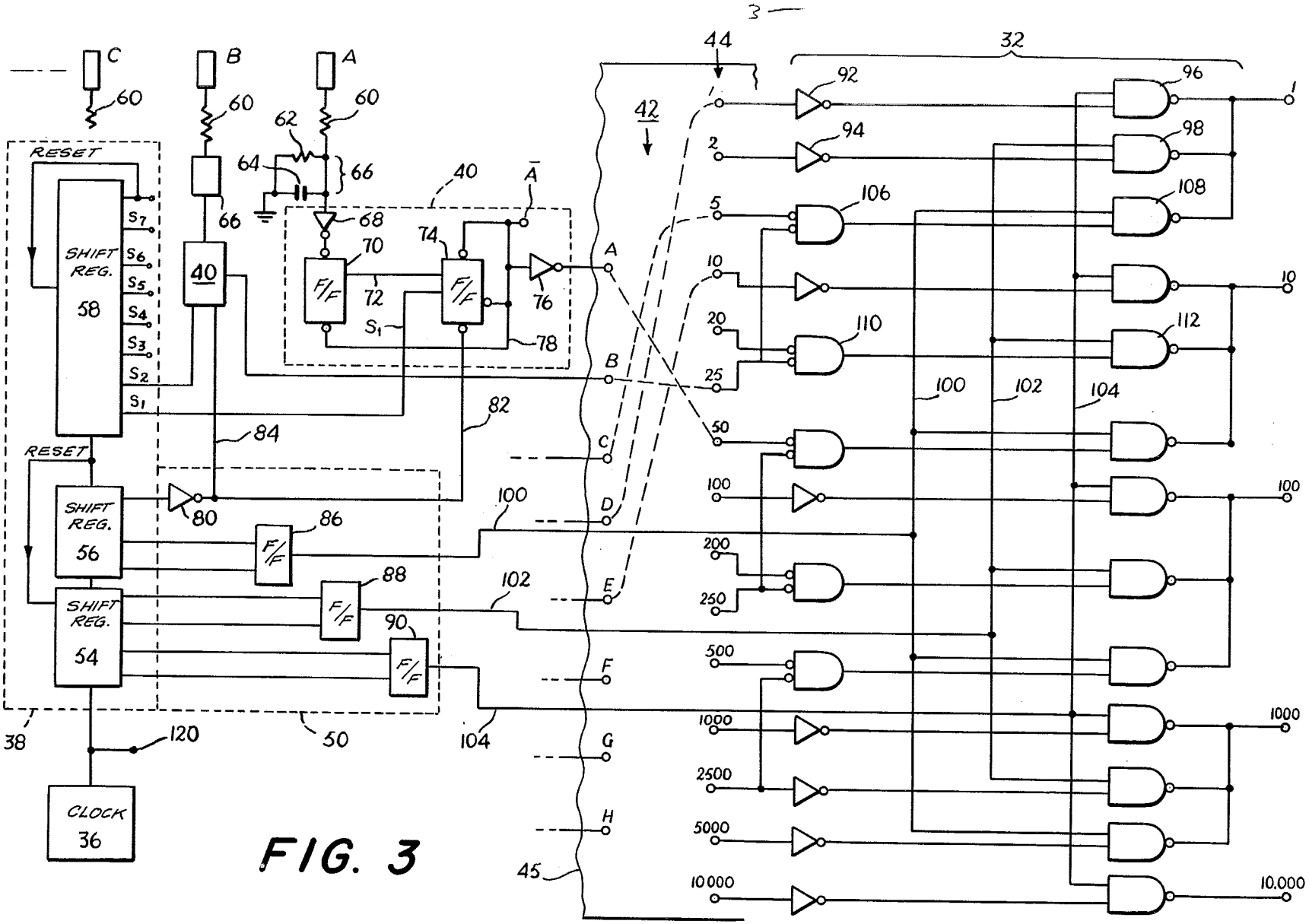
Figure 4:
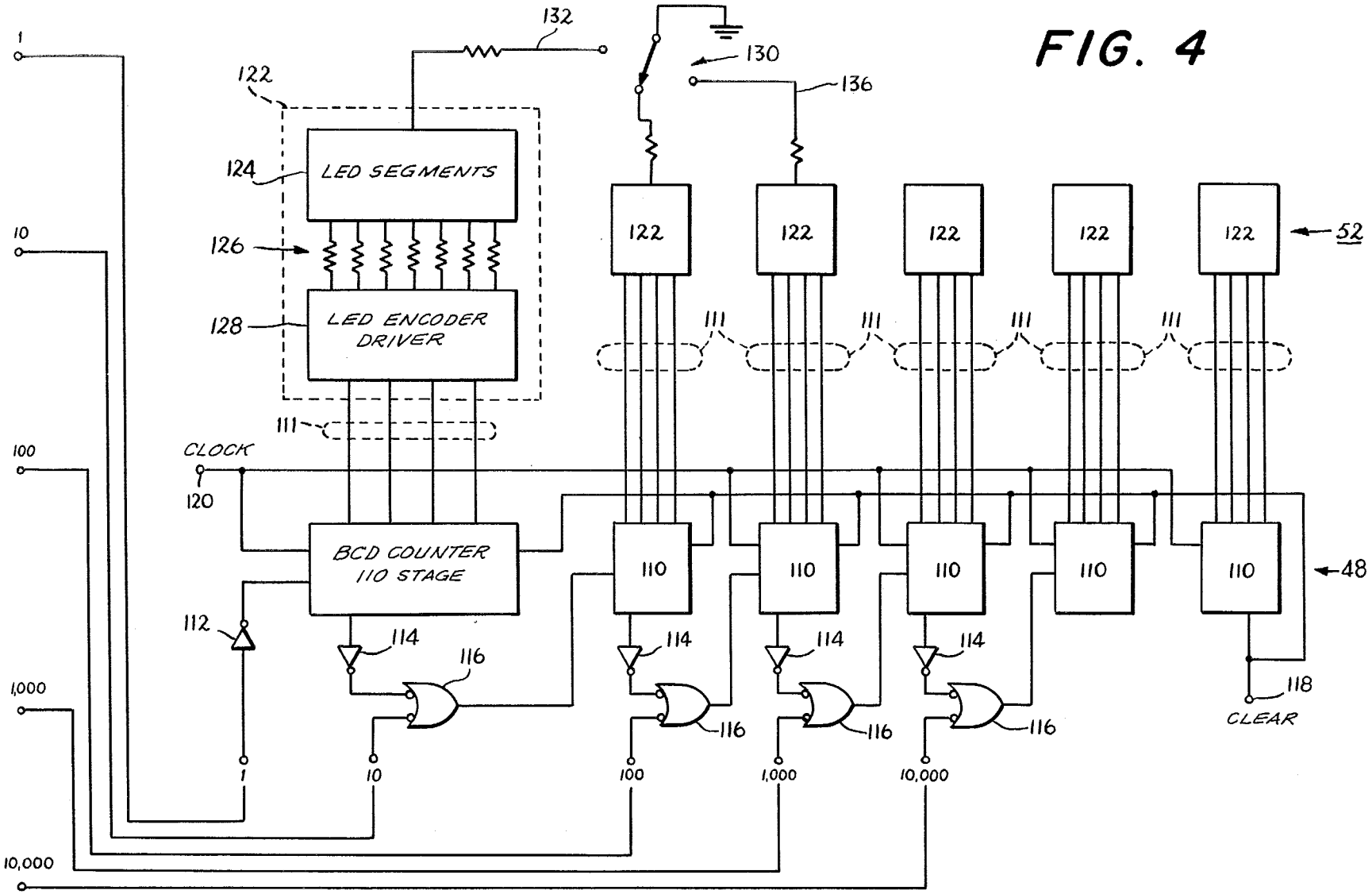

FIGS. 3 and 4 together comprise a more detailed circuit diagram of the circuit shown in FIG. 2;

FIG. 5 is a timing diagram used in explaining the operation of the circuit shown in FIGS. 2–4;

FIG. 6 is a schematic circuit diagram of a portion of the operating circuit of the device shown in FIG. 1; and FIG. 7 is a schematic circuit diagram of an alternative embodiment of the invention.

FIG. 1 shows a coin sorter-totalizer device 10. The device 10 includes a housing 12 with transparent hinged covers 14 and 16. Beneath the cover 14 is a hopper 17 into which coins to be sorted are loaded. A conventional sorting mechanism is provided. This mechanism includes a rotary sorting wheel 18 to pick the coins up one-by-one and transfer them down a chute past a series of devices (illustrated schematically) which detect the diameters of the coins passing by, and deflect the coins into separate intermediate trays 20, one for each coin diameter. Coins of the largest diameter are removed first, and the smallest last. Each selector element includes a coin detector (A through H) which is a photoelectric or radio-frequency proximity detector for developing an electrical signal in response to the passage of a coin on its way to its intermediate storage tray 20. The device 10 includes totalizer circuitry which adds the values of the coins and indicates the total value on a display panel 24.

After a batch of coins has been sorted and counted, and the total value appearing on the display 24 has been checked, the contents of each of the intermediate trays 20 can be released by the operator by operation of a lever 28 on the left hand side of the machine so that the contents of the intermediate trays fall into the lower drawers 22 from which the coins easily can be removed.

FIG. 2 is a simplified schematic diagram of the totalizing circuit of the sorter-totalizer 10. The coin detectors 34 are labeled A through H to correspond to the labeling in FIG. 1. The signals developed by each of the detectors is stored temporarily in one of eight electronic latches 40. A shift register 38, driven by a clock source 36, sequentially samples the latches 40 and reads out their contents onto the terminals labeled vertically A through H. A multiplier circuit 32 is provided for scaling the coin detector signals. The multiplier circuit has 15 input leads 44 which are marked with the numbers 1, 2, 5 . . . 10,000 in FIG. 2. The numbers marked adjacent the wires correspond to the multiplication factor provided by connecting one of the coin detector terminals A through H with that multiplier circuit input terminal.

In accordance with the present invention the vertical row of terminals A through H and the multiplier input terminals 44 are arranged in two sets adjacent one another so that connection between terminals can be made quickly and easily by connecting jumper wires 42 in the manner shown in FIG. 2.

The multiplier circuit produces pulses on five output lines numbered 1, 10, 100, 1,000 and 10,000. These lines are connected to a six-digit binary-code decimal counter 48. The counter counts the signals from the output leads of the multiplier circuit 32, and displays them on a six digit light-emitting diode ("LED") display 52. It is this display which appears in the panel 24 in the front cover of the sorter-totalizer in FIG. 1. As it will be explained in greater detail below, the multiplier circuit 32 is unique and advantageous in that it provides logic circuitry for combining three input signals $P_1$, $P_2$ and $P_5$, which are pulses of 1, 2 and 5 clock pulses long each.

FIGS. 3 and 4 show further details of the circuitry shown in FIG. 2.

Now turning to FIG. 3, three of the coin detectors A, B and C are shown in the upper left-hand corner of the drawing. The other detectors have been omitted in order to avoid unnecessary repetition.

The first detector A is connected through a resistor 60 and a circuit 66, consisting of a parallel resistor 62 and capacitor 64, to an integrated Schmidt trigger amplifier 68 which produces an output pulse with a steep wavefront for operating the latch circuit 40.

The latch circuit 40 includes two flip-flops 70 and 74. Normally, flip-flop 70 is set and flip-flop 74 is reset. When a signal is delivered to flip-flop 70 from the coin detector device, flip-flop 70 changes state and sends a signal over line 72 to the second flip-flop 74. The flip-flop 74 is a clocked device which requires a signal on input line 75, as well as on line 72, before it will produce an output. When a sampling signal is supplied on line $S_1$ (line 75), the flip-flop 74 changes state and produces an output signal on terminal A through an inverting amplifier 76. Towards the end of the sampling cycle, while $S_1$ is still energized, a reset signal is delivered through an inverting amplifier 80 over a line 82 to the reset terminal of flip-flop 74. The output of flip-flop 74 is sent back over line 78 to the reset terminal of flip-flop 70 so that it is set to its initial condition again. It should be understood that the shift register 38 operates through hundreds of cycles per second, a rate which is much higher than the rate of sorting coins.

Each of the other coin detectors B through H is connected to circuitry identical to that to which detector A is connected, except that each latch circuit 40 is connected to a different one of the shift register terminals $S_2$, $S_3$ . . . $S_8$.

The shift register circuit 38 actually consists of three series-connected shift registers 54, 56 and 58. The timing of the operation of the shift registers 54, 56 and 58 is indicated in the waveform diagrams of FIG. 5.

Referring to FIG. 5, a series of clock pulses is shown in the upper portion of the drawing. The time period shown is a little more than 16 clock pulses, which is slightly more than one cycle of operation of the shift register 58.

During the first cycle of operation, shift register output line $S_1$ is energized. The signal on line $S_1$ is shown in FIG. 5 and lasts for approximately 16 clock cycles. As is shown in FIG. 3, two flip-flops 88 and 90 are connected to output lines from shift register 54, and one flip-flop 86 is connected to outputs from shift register 56. The two input lines to flip-flop 90 are connectd to the shift register 54 so that the flip-flop 90 operates for just one clock cycle. This produces a pulse $P_1$ on the output line 104 shown in FIG. 3 slightly after the start of signal $S_1$. The pulse $P_1$ is shown in FIG. 5.

Similarly, the flip-flop 88 is connected to the shift register 54 so that it is turned on for two clock cycles. This produces the pulse $P_2$ (FIG. 5) on output line 102 (FIG. 3).

Also similarly, flip-flop 86 is connected to the shift register 56 so that it is turned on for five clock cycles. This produces a signal $P_5$ equal in length to five clock cycles on line 100 (FIG. 3). Towards the end of the signal $S_1$, the shift register produces a negative reset pulse R (FIG. 5) which is delivered over lines 82 and 84, etc. to reset the latches 40.

Shortly after the reset pulse is completed, the shift register 56 overflows and shift register 58 steps one step. This ends signal $S_1$ and starts signal $S_2$ (FIG. 5). Similarly, the entire cycle is repeated and signal $S_2$ ends when signal $S_3$ starts, as is indicated schematically in FIG. 5.

The purpose of the 1, 2 and 5 clock-pulse long trains produced on lines 100, 102 and 104 will be explained below.

Referring again to FIG. 3, the multiplier circuit 23 is provided for "scaling" (i.e., multiplying) the signals appearing on terminals A through H by an appropriate scaling factor. A separate input terminal is provided for each of a plurality of different scaling factors. The scaling factor for each input terminal is indicated by the number next to it. Thus, there are 15 different scaling factors, 1, 2, 5, 10, 20, 25, 50, 100, 200, 250, 500, 1,000, 2,500, 5,000, and 10,000.

In accordance with one aspect of the invention the coin identification terminals A through H and the multiplier circuit input terminals 44 are mounted adjacent one another on a printed circuit board 45 so that they can be connected by means of jumpers very readily. The connection process is very simple; all that need be done is to connect one jumper from a given coin identification terminal to a particular multiplying circuit input terminal. For example, the jumpers 42 shown in FIGS. 2 and 3 are connected as they would be for sorting and totalizing United States coins. Since the largest coin normally counted in the United States is a 50-cent piece, terminal A (corresponding to the largest coin detector) is connected to the "50" input terminal. Similarly, terminal B, which identifies quarters, is connected by a single jumper wire by the "25" input terminal. The third largest coin in diameter is the nickel. Therefore, terminal C is connected to the "5" input of the multiplier circuit 32. Similarly, terminal D is connected to the "1" terminal, and terminal E, for dimes, is connected to the "10" terminal. Thus, it is extremely easy to correlate the coin identification terminal with its proper multiplier input terminal because of the direct correspondence of the scaling factor for each of the input terminals to the value of the coin.

When it is desired to adapt the totalizer device to operation with coinage of another country, a different arrangement of jumper wires can be used. The number of coin identification terminals and multiplier input teminals 44 is sufficient to enable the device to be used for the coinage of almost all countries in Europe and North America.

The multiplier circuit 32 shown in FIG. 3 consists of a number of gates and inverters interconnecting the input terminals 44 with the three lines 100, 102 and 104 to produce signals on the output terminals 1 through 10,000. The way in which this is done is readily apparonly egress, from the manifold to the top interior of the oven.

The left compartment 47 of the bottom rear housing is, more specifically, a recirculation collector for the oven and, for this purpose, the walls of only this half of the housing are provided with various openings. The latter include, in the illustrated embodiment, top wall slots 56, a series of louvered openings 57 in the front top vertical wall section, and some additional louvered slots 58 across the front lower wall section. As has already been pointed out, this collector compartment within the housing encloses the left oven bottom opening 40 of the mixing chamber 35.

What has been described so far, including the oven vent and the supply of make-up air, with the two operationally balanced, comprises the forced circulation system of the oven thermally powered by the gas burner and convectively by the blower. The latter is mounted on a shaft that extends to the rear through an enlarged opening 60 in the blower housing to an electric drive motor 61 at the back of the outer liner of the oven. The opening is large to permit insertion and removal of the blower, but is closed about the shaft by a removable and thermally insulated plate assembly 62 that also supports the motor mount. The motor is partially enclosed by a housing 63 attached to the rear of the outer liner, with a substantial rear wall opening and open sides as well.

Since the blower shaft will, nevertheless, become very hot during operation of the oven, its motor support bearing requires special attention, and the shaft is shown as provided at the bearing end with a spider having a number of inclined vanes 64 spaced about the same. This vane ring or spider is driven by the shaft and is operative to pull in the room air through slots 66 in the toe plate 67, and also under the main base 68 through openings 70 therein for circulation about and through the motor for cooling. The cooling air passing over the blower motor 61 travels across the exterior sides of the outer oven liner 12 and then exits through slots 72 into the space between the door 21 and outermost range sides, as best shown in FIG. 3. It will be appreciated that this motor air cooling system is completely separate and isolated from the circulation through the oven cooking cavity.

Such oven circulation system can now be traced in operation, referring also to the air flow arrows included in the drawing, as commencing with driving the blower or fan and igniting the gas burner. The burner flame 65 is directed from the front into the left end portion of the mixing chamber 35, and the burner configuration together with suction created at the center of the blower provide a long torch-lie flame that bends an appreciable distance into and along the length of the mixing chamber, with some upward impetus, as illustrated. Considering only the combustion products of the burner, and the excess of room air that flows as make-up air through the burner box, this flow proceeds from the right hand section of the mixing chamber, through the oven bottom opening 39 and the right compartment 46 of the housing 41 to the center or eye of the blower 51. As forcibly discharged by the blower, the flow continues upwardly over the rear wall of the oven through the expanding blower housing 50 to enter the oven top manifold 53 through the rear wall openings 52.

The heated air and gases are discharged from the manifold downwardly through holes 55 into the oven, with the forwardly tapered form of the manifold assisting to maintain the discharge substantially uniform from the back to the front, so that the useful rack area in the oven is downwardly traversed by the hot air to the bottom portion of the oven. A determined quantity of flow will, of course, be bled off or exhausted through the oven vent 24, while the major portion by far of the heated air in the oven is withdrawn through the collector section 47 of the bottom rear housing 41 and returns to the mixing chamber 35 through the left oven bottom opening 40, generally opposite the burner housing. Such outflow from the oven thus becomes a recirculation flow that is almost immediately drawn into the burner flame and the make-up air supplied through the burner box. The two flows, obviously at different temperatures, become well mixed to form a more uniform combined feed to the blower, and continued operation is, of course, repetitive of the foregoing.

It will, furthermore, be obvious that the described arrangement provides extremely efficient burning of grease and other volatiles in the oven outflow well in advance of the blower inlet, and it has been found that it is not necessary in this system to employ grease filters or other additional scrubbing means for the recirculated air.

It will also be appreciated that the controls for the burner and the blower will include some suitable form of door interlock, not shown, so that they cannot operate unless the door is fully closed, with this feature obtaining in all operations of the oven.

The basic advantages of a convection oven, as compared to conventional ovens, are speed and conservation of energy, with the former of course a factor in the latter, but also a significant directly realized benefit for the user. A evidenced by extensive testing, with this new oven it is possible to perform all of the usual oven cooking operations in much shorter times than normally required in conventional ovens, including broiling as well as baking and roasting. Due to such oven design, the heat circulation and efficiency of the oven are much improved over conventional ovens, and as a result it is possible to broil meats at lower temperatures than in a conventional oven. Assignee's prior mentioned patent application Serial No. 303,325 cites a number of specific examples of very appreciable reduction in cooking times for various foods, as well as broiling times, and it is estimated that a gas convection oven can provide an average energy savings on the order of about thirty percent, excluding conventional oven pilot consumption. The new oven herein described provides such advantages as well in a reproducible construction with assured uniform high quality performance.

We claim:

1. In a blower powered convection oven, a blower which receives an outflow of the oven air to be recirculated and an inflow of heated room air for charging the oven, the oven being vented, an air mixing chamber having an inlet portion, a mixing portion and an outlet portion, means providing communication between said outlet portion and the inlet of the blower, means for delivering the oven outflow to the inlet portion of the mixing chamber, and means for delivering the heated room air likewise to said inlet portion, whereby the oven outflow and heated room air are comingled in passage through the mixing portion of the chamber and supplied as a mixture thereof to the inlet of the blower for hot air feed to the oven.

2. In an oven as set forth in claim 1, wherein the oven outflow is confined by collector means for contained delivery of the same to the mixing chamber.

3. The oven as set forth in claim 2, wherein means are provided for introducing the oven outflow and heated room air into the inlet portion of the mixing chamber along substantially immediately intersecting flow paths.

4. The oven as set forth in claim 3, wherein the room air is heated and the oven outflow reheated by direct exposure of such room air and oven outflow to the same gas burner means.

5. In an oven as set forth in claim 4, wherein the gas burner means produces a flame that extends appreciably into the mixing chamber to combust volatiles contained in the oven outflow to be recirculated.

6. The oven as set forth in claim 1, wherein means are provided for introducing the oven outflow and heated room air into the inlet portion of the mixing chamber along substantially immediately intersecting flow paths.

7. The oven as set forth in claim 6, wherein the room air is heated and the oven outflow reheated by direct exposure of such room air and oven outflow to the same gas burner means.

8. In an oven as set forth in claim 7, wherein the gas burner means produces a flame that extends appreciably into the mixing chamber to combust volatiles contained in the oven outflow to be recirculated.

9. The oven a set forth in claim 1, wherein the room air is heated and the oven outflow reheated by direct exposure of such room air and oven outflow to the same gas burner means.

10. In an oven as set forth in claim 9, wherein the gas burner means produces a flame that extends appreciably into the mixing chamber to combust volatiles contained in the oven outflow to be recirculated.

11. In a convection oven including hot air supply means for discharging such air downwardly substantially fully over the top of the oven, air outlet means at the oven bottom, blower means for recirculating the oven air in such downward flow through the cooking space thereof, heating means for reheating the oven air during its flow from said air outlet means to the inlet of said blower means, and means for adding heated room air to the recirculating flow; means for mixing the air from the oven with the heated room air for combined mixed flow of the same prior to entering said blower means, including a separate thermally insulated mixing compartment, means for conducting the oven air to said compartment, means for introducing the heated room air to said compartment in the same region thereof as the oven air entry, said compartment having a separated outlet, and means for flow interconnection of said outlet and the inlet of said blower means, whereby said blower means draws the oven air for recirculation and the heated room air together in mixing flow through said compartment prior to discharge of the mixture into the top of the oven.

12. In an oven as set forth in claim 11, including collector means at a bottom rear part of the oven for containing the oven air as withdrawn for such conduction of the same to the mixing compartment.

13. In an oven as set forth in claim 12, wherein the room air is drawn over the heating means in its delivery to the mixing compartment.

14. In an oven as set forth in claim 13, wherein the heating means is gas burner means within a burner box that communicates directly with the mixing compartment.

15. In an oven as set forth in claim 14, wherein the burner means produces a flame that extends appreciably into the mixing compartment.

16. In an oven as set forth in claim 15, wherein the burner flame is directed toward the entry of the oven air to the mixing compartment.

17. In an oven as set forth in claim 11, wherein the means for conducting the air from the oven to the mixing compartment and the mixture of oven air and heated room air from the compartment to the blower means includes first and second openings at the bottom rear of the oven.

18. In an oven as set forth in claim 17, wherein said first and second oven openings are enclosed by a common divided housing having separate oven air outflow and blower means inlet passages communicating, respectively, with the oven and the inlet of the blower means.

19. In an oven as set forth in claim 18, wherein the heating means is gas burner means having a flame that projects into the mixing compartment.

20. In an oven as set forth in claim 19, wherein the room air is drawn over said burner means for heating the same.

21. In an oven as set forth in claim 20, wherein the burner flame is directed at the inflow of the oven air to the mixing compartment.

22. In an oven as set forth in claim 21, wherein the burner flame extends substantially along the air flow through the mixing compartment.

23. A convection oven comprising housing means disposed transversely against the bottom rear of the oven and defining an enclosure, an intermediate partition forming separate side-by-side compartments within such enclosure, an opening to the exterior of the oven in each compartment, one compartment also having an opening to the interior of the oven and thereby providing for outflow of the oven air through the same, and blower means for supplying air to the oven, the other compartment having an outlet for connection to the inlet of said blower means, whereby oven air withdrawn through said one compartment can be returned through the other for recirculation by the blower means.

24. A convection oven as set forth in claim 23, including means for reheating the oven air outflow in its passage from said one to said other compartment of the housing means.

25. A convection oven as set forth in claim 24, including means for adding a predetermined inflow of room air to the oven air outflow in its such passage.

26. The method of cooking food by forced hot air flow, that comprises the steps of forcibly discharging the hot air against the food, collecting the air after passage over the food and forming a contained flow of the same, forming a smaller separate flow of ambient air, bringing the two such air flows together in a confined space for intermixing of the same while applying heat thereto, and pressurizing the heated mixture to produce the hot air forcibly discharged against the food, the major portion of the hot air used for cooking thus being recirculated.

27. The method set forth in claim 26, including the further step of removing particulate matter entrained in the flow in its passage over the food before it is recirculated.

28. The method set forth in claim 27, wherein the particulate matter is removed by combusting the same by the heat applied to the two air flows during intermixing of the same in such confined space.

and said input terminals in accordance with the value to be ascribed to the coin identified by the signal on each identification terminal in the country in which the totalizer is to be used.

14. A method as in claim 13 in which said interconnecting step comprises connecting only one jumper wire between each of a selected group of said identification terminals, and one of said input terminals.

15. A method as in claim 13 in which said interconnecting step comprises connecting a pre-wired multiple circuit element between said identification and input terminals.

* * * * *